US005456243A

United States Patent [19]

Jones

[11] Patent Number: 5,456,243

[45] Date of Patent: Oct. 10, 1995

[54] THERMAL BLOCK FOR DOOR ASSEMBLY

[76] Inventor: Robert F. Jones, 216 Marshall Dr., Louisville, Ky. 40207

[21] Appl. No.: 262,578

[22] Filed: Jun. 20, 1994

Related U.S. Application Data

[63] Continuation-in-part of Ser. No. 921,768, Jul. 30, 1992, abandoned.

[51] Int. Cl.[6] ..... F23M 7/00

[52] U.S. Cl. ..... 126/197; 292/DIG. 66; 292/DIG. 69

[58] Field of Search ..... 126/197, 190, 126/198, 191; 292/DIG. 66, DIG. 69, 341.16, 113

[56] References Cited

U.S. PATENT DOCUMENTS

| | | | |
|---|---|---|---|
| 2,767,011 | 10/1956 | Buckley | 292/DIG. 66 |
| 3,362,398 | 1/1968 | Fahe | 126/197 |
| 3,815,942 | 6/1974 | White | 292/DIG. 66 |
| 3,912,904 | 10/1975 | Phifer | 126/197 |
| 4,364,589 | 12/1982 | Watson | 126/197 |
| 4,718,705 | 1/1988 | Case | 292/DIG. 69 |
| 4,862,870 | 9/1989 | Fox | 126/197 |

FOREIGN PATENT DOCUMENTS

| | | | |
|---|---|---|---|
| 811033 | 4/1969 | Canada | 292/DIG. 69 |

*Primary Examiner*—James C. Yeung

[57] ABSTRACT

A lock for a door latch which includes a bolt moveable from a first position where the door is unlatched to a second position where the latch engages the door to hold the latch in the second position at selected temperatures.

6 Claims, 4 Drawing Sheets

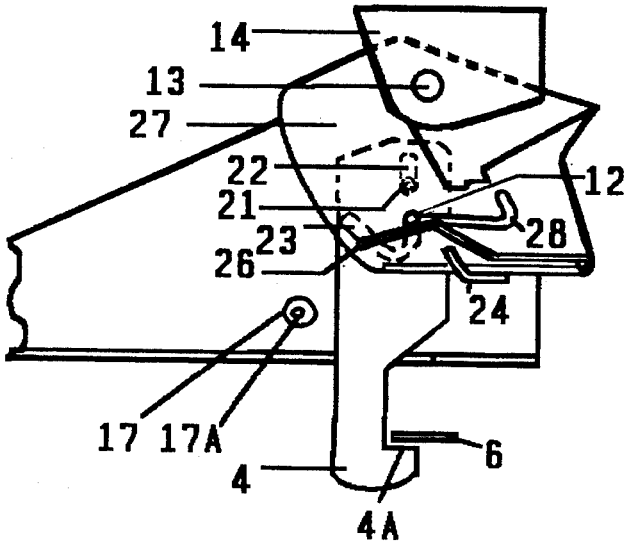
Figure 4
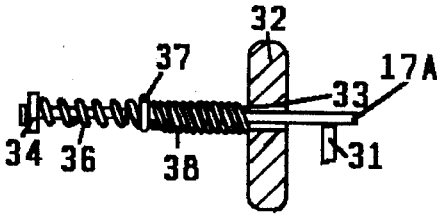
Figure 5B
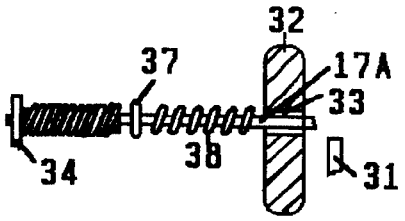
Figure 5A
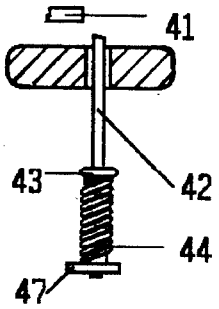
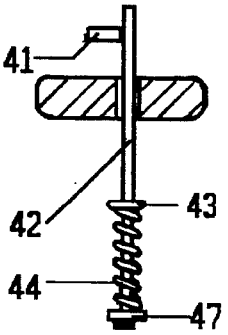
Figure 6A Figure 6B

THERMAL BLOCK FOR DOOR ASSEMBLY

BACKGROUND OF THE INVENTION

The present invention relates in general to door latches and more particularly relates to a door locking arrangement useful with appliance doors, especially the doors of so called self cleaning ovens to latch out the door during the high temperature cleaning operation.

Many kitchen and even commercial stoves now provide self-cleaning features which have heating means to generate very high temperatures within the oven during a cleaning cycle to pyrolytically decompose organic deposits on the surfaces of the oven. Such temperatures often exceed 380 degrees Fahrenheit.

The high temperatures involved in self-cleaning ovens can cause both personal and property damage if the oven is opened during the cleaning cycle. Accordingly, there is great interest in means to prevent opening the door during the high temperature cycle.

Some prior art ovens and the like which utilize self cleaning features have used a manual latch to be fastened when the self cleaning cycle is activated. In such systems a physical release is required to cause release of the door.

Such systems have the disadvantage that the door can still be inadvertently opened and so have required the development of means to to prevent the inadvertent opening of the door. In one case electrical means are provided generally where a solenoid or other such device is provided to be operated by a temperature system to lock the door latch when the oven is in the cleaning cycle.

In other cases temperature responsive bimetallic elements have been used to position pawl devices to prevent operation of the door release mechanism when the oven is in the cleaning cycle. Examples of such devices are shown in U.S. Pat. No. 3,438,666.

Additional such devices are shown in U.S. Pat. Nos. 3,540767 and 4,133,337.

However such systems suffer to some extent from time lag in both the heating and cooling periods leading to some liklihood of inadvertently opening the door during the heating cycle. U.S. Pat. No. 3,540,767 deals with this problem by limiting rotation of the bimetal strip.

However, temperature characteristics of ovens, even ovens from the same manufacturer vary widely and make it difficult to manufacture devices which fit all circumstances.

U.S. Pat. No. 4,862,870 teaches a snap action system using a pair of bimetal strips where one of the strips moves a locking pin to prevent release of the door latch mechanism while the second strip independently prevents movement of the locking pin until the second strip responds to lower temperature in the oven or chamber.

All of the prior art devices intended to accomplish the same or similar objectives as the present invention utilize complex multiple piece arrangements which, because of their complexity and number of individual cooperative elements, inherently have a high probability of failure relative to the straightforward assemblies permitted by the present invention.

No prior art arrangement is known which recognizes the benefits of the use of counterbalanced spring devices to lock a door latch mechanism where one of the springs is temperature responsive and overcomes the force exerted by another spring at selected temperature to lock the door release mechanism during periods of high temperature in the oven. Similar results are achieved by the use of gravity.

SUMMARY OF THE INVENTION

The present invention provides a new and useful locking arrangement for use with ovens or other appliances and specifically with so so called "self-cleaning" ovens.

Devices within the scope of the present invention are useful and effective to lock the release mechanism of a door, for example the door of an oven or other device, to prevent opening the door during periods when the temperature in the oven or other enclosure exceeds a selected minimum.

The counterbalanced temperature responsive spring mechanism of the present invention is highly effective and quickly responsive to temperature change within the heated enclosure to substanially reduce the liklihood of inadvertant opening of the enclosure when heated.

Furthermore,the number of elements required for assembly of latching arrangements within the scope of the present invention is substantially less than the number required for prior art devices thereby reducing both the production cost and the liklihood of failure.

Additionally, the simple nature of devices within the scope of the present invention allows the fabrication of compact devices which can be easily mounted to the latch mechanism and removed without disturbing the latch mechanism.

In some cases some users find it desireable to latch the oven for a cooking cycle in order to obtain the seal normally provided in the selfcleaning condition.

Briefly the present invention provides a latch for doors such as oven doors which includes a latch subassembly having a bolt moveable between latched position to engage a door and hold the door closed and an unlatched position where the door is released where the latch includes a lock assembly to lock the latch assembly in the latched position when the temperature of the lock assembly exceeds a preselected elevated temperature. The lock assembly includes a locking pin to engage the latch in the latched position at temperatures above the elevated temperature so the latch cannot be released to allow the door to be opened, a first spring disposed to urge the pin away from the latch assembly and a second spring which is disposed to oppose the force exerted by the first spring where the force exerted by the second spring is a function of the temperature of the second spring so that at the selected elevated temperature the force exerted by the second spring exceeds the force exerted by the first spring and the pin is moved to engagement with the latch to prevent release of the door so long as the temperature of the second spring exceeds the selected elevated temperature.

In other cases it is desireable to have the ability to accelerate the time required to cause the latch to close and the present invention provides effective and efficient means to cause early latch closure.

Examples of arrangements within the scope of the present invention are shown in the accompanying drawings and described in more detail hereinafter but it will be recognized that neither the drawings nor the descriptions thereof are by way of limitation and that other arrangements also within the scope of the present invention will occur to those skilled in the art upon reading the disclosure set forth hereinafter.

BRIEF DESCRIPTION OF THE DRAWINGS

One example of an arrangement within the scope of the present invention is illustrated in the accompanying drawings wherein:

FIG. 4 is a plan view of the arrangement shown in FIGS. 2 and 3 in latched position and set to receive a pin in accordance with the present invention;

FIG. 5A is an exploded elevational view of an example of a pin lock arrangement within the scope of the present invention with the pin in retracted position;

FIG. 5B is a view of the arrangement shown in FIG. 5A with the pin in extended locking position.

FIGS. 6A and 6B are illustrations of another arrangement within the scope of the present invention with the temperature responsive spring opposed by gravity actuation means for the pin;

DETAILED DESCRIPTION OF THE DRAWINGS

Figure 1:
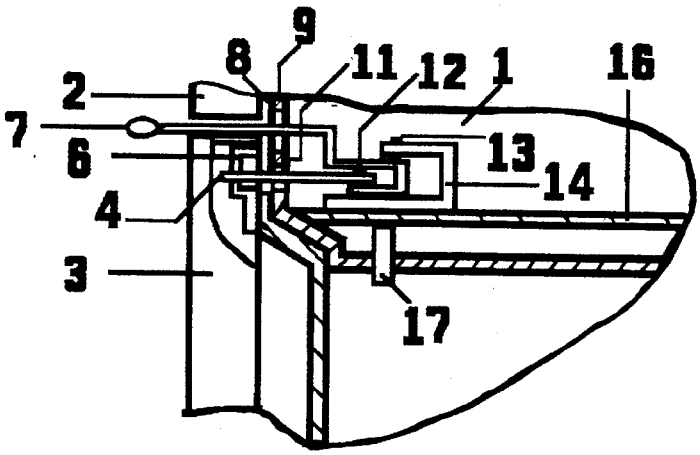
FIG. 1 is a sectional elevational view of one arrangement within the scope of the present invention.

FIG. 1 illustrates one of several possible arrangements where devices within the scope of the present invention can be used. Further, while the examples within the scope of the present invention are described with reference to a cooking stove it will be understood that the principles of the present invention can be used equally well in other applications.

In FIG. 1 an outer wall 1 of an oven is shown. A door 3 is provided and the oven chamber is adapted to receive the door as shown.

An upper chamber is defined by a wall 18 to receive the door latch assembly which includes a "U" shaped bracket 14 as shown having a long lower leg and a shorter upper leg. A bolt 4 is provided to be pivoted on a mounting bracket 27 which in turn is pivotably mounted on bracket 14 by means of pin 13.

An operating lever 7 is provided and pivotably mounted to bracket 27 so that the handle projects outwardly through a cooperative opening 8 in the stove wall. As also shown, bolt 4 also projects outwardly so the groove 4A can be positioned to receive a strike 6 carried inside the door and accessed through opening 11 of the stove frame to selectively secure the door in closed position. A thermally activated lock mechanism 17 within the scope of the present invention is provided as shown and extends into the oven so that the element is exposed to the temperature in the oven.

Figure 2:
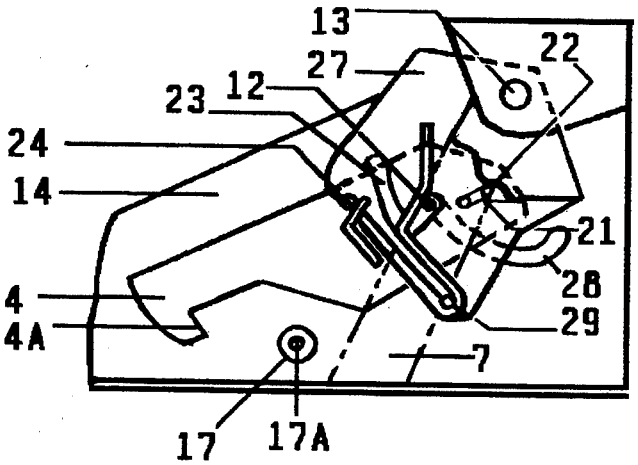
FIG. 2 is a plan view of an example of a latch arrangement useful in arrangements of the type shown in FIG. 1 shown in a first unlatched mode.
Figure 3:
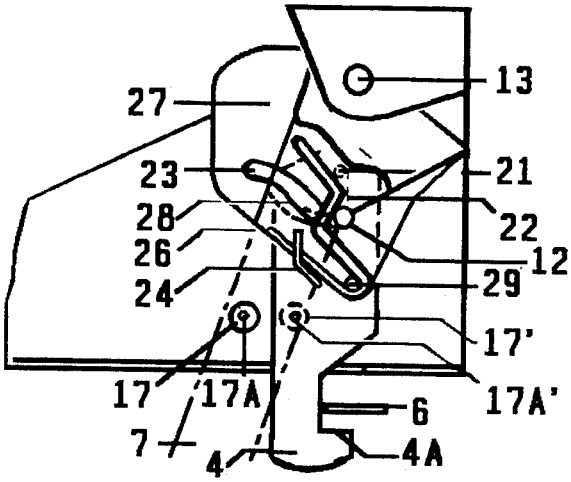
FIG. 3 is a plan view of he arrangement shown in FIG. 2 where the device is in prelatch position.

The elements of the illustration of FIG. 1 are illustrated in FIGS. 2–4 where the same numerals are used for the identification of the various elements described with reference to FIG. 1.

As shown in the FIGS. 2–4 the bolt 4 is provided with a roughly "L" shaped slot 23 and the bracket 27 is also provided with a slot 28 shaped to accomplish the movements required for successful operation of the latch as described hereinafter. A pin 12 is provided to be received in both slots 23 and 28 so that as the handle 7 which extends outwardly from bracket 27 is moved counterclockwise from the position shown in FIG. 2 to the latched position shown in FIG. 4 the bolt 4 is first rotated toward strike 6 then through the cooperative action of pin 12 in slots 23 and 28 and the movement provided by pin 21 in slot 22 of bolt 4 the bolt moves endwise inwardly to clasp strike 6.

The guide slot 28 in the mounting bracket first curves outwardly and pin 12 moves outwardly along the slot during the swinging motion of the bolt 4 to the extended position shown in FIG. 3. When bolt 4 reaches the extended position follower 42 is positioned as shown in FIG. 4 at the sharp bend in the slot between the hooked end portion and the longer left portion of the slot.

Due to the shape of the slot 28 chosen for purposes of illustration a spring 26 is provided to assure the continued smooth movement of the elements as handle 7 is swung from the position shown in FIG. 3 to the position shown in FIG. 5.

Spring 27 is a torsion spring coiled intermediate its ends around spring 26 on the plate with one leg of the spring anchored against a lug 29 upstanding from the plate and the other leg pressed against the the side of follower pin 12. Thus as the lever swings to the right and begins to draw bolt 4 the spring continuously but yieldably presses the pin in the same direction to prevent it from moving idly in the slot.

During continued rotation of handle 7 after the bolt 4 reaches the position shown in FIG. 4, the follower pin 12 and the bolt are cammed inwardly to draw the bolt into engagement with the strike 6. Bolt 4 moves inwardly along the slot 22 guided by pin 21 until the bolt reaches the latched position.

It will be understood that devices within the scope of the present invention can be used with a wide variety of latch assemblies and that the assembly shown in the Figures is for purposes of illustrating the use of a device within the scope of the present invention an example of which is illustrated in FIGS. 5A–5B.

In FIGS. 1–4 the example of a device within the scope of the present invention is shown as element 17. The device includes a pin 17A which extends upwardly to prevent movement of the bolt 4 and release of the bolt from the strike 6 when the oven door is closed and the temperature inside the oven exceeds the minimum temperature determined by the characteristics of the device.

Two locations are shown for the device in FIGS. 2–4. In one case the device is located to the left of bolt 4 when the bolt is in the position shown in FIGS. 3 and 4 where the bolt is latched to strike 6 or in position for latching so that when pin 17A is extended by exposure to a temperature in excess of the minimum as described hereinafter the pin prevents clockwise rotation of the bolt 4 and prevents disengagement of bolt 4 from strike 6. In the other position shown the device 17 is positioned so that when pin 17A' is extended it is received in a cooperatively located hole 20 in the bolt to prevent movement of the bolt out of engagement with the strike 6.

One example of a device useful in the application described hereinbefore is shown in FIGS. 5A–5B. In FIG. 5A the device is located in a mounting plate 32 with a hole 33 which receives pin 17AA. an end stop 34 and intermediate stop 37 are provided on pin 17A.

A stop 31, such as strike 6, to be engaged by pin 17A is shown. In the example of FIG. 5A pin 17A is in the retracted position so the end of pin 17A is below stop 31 and would allow free movement of the stop.

A coil spring 38 is provided between plate 32 and stoop 37 to normally hold pin 17A in the position shown in FIG. 5A. A second spring 36 is shown between stops 34 and 37 where stop 34 is fixed to a solid mount (not shown) and pin **17*a* can move in stop 34**.

In accordance with one feature of the present invention spring 34 is made of a thermally responsive material where the shape of the material changes in response to temperature change. By producing the material in the shape of a coil spring as shown the change in temperature in the oven where the device is located will cause the force exerted by spring 36 to overcome the force exerted by spring 38 so that spring 38 is compressed and pin 17A is extended to the position shown in FIG. 5B to engage stop 31 to prevent movement of the stop past the pin.

Spring 36 can be made of any suitable material to accomplish the objectives of the particular application. In one instance suitable springs have been made of a memory metal such as "Tinel" (TM) a Ni—Ti alloy which exhibits properties based on the difference in stiffness of the alloy at low temperature in the martensitic condition and at a higher, transformation, temperature in the austenitic condition. In these case spring 36 expands and contracts along a straight line in response to heating and cooling. The transformation temperature is determined by the particular alloy composition and can be selected to provide the transformation at a temperature in the range of the temperature achieved in the self cleaning phase of an oven.

While the present invention has been described in terms of the use of a "memory" metal it will be understood that other suitable arrangements, even bimetal springs can be used within the scope of the present invention.

FIGS. 6A–6B illustrate an arrangement within the scope of the present invention where memory element spring 44 is carried on shaft 42 which rises and lowers as the device is heated and lowers as the device colls as previously described. In the case on the configuration shown in FIGS. 6A–6B the memory spring is biased by a weight 43 and the shaft is supported by a fixed base 47.

It has also been recognized that upon initial closure of the latch and while the oven or other area is being heated the door can be opened and injury could result. Accordingly in some instances it is desireable that the closure be accelerated and the present invention provides means to selectively actuate the memory metal to prelock the latch before the temperature in the heated area reaches the selected temperature.

Examples of such arrangements are shown in FIGS. 7A–7B to 10–10B.

Figure 7A:
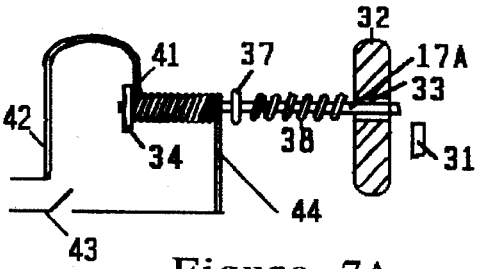
FIGS. 7A and 7B are illustrations of another arrangement within the scope of the present invention with electrical actuation means for the pin.
Figure 7B:
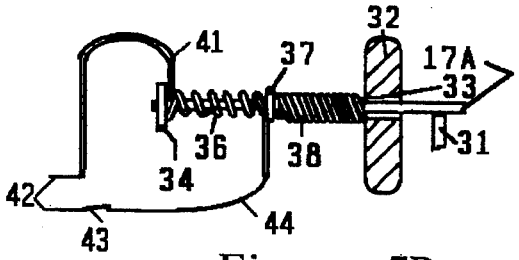

In FIGS. 7A–7B a power source 42 is provided to supply electrical current to the leads 41,44 of the coiled memory element 36. When power is supplied to the element the resistance of the element generates heat and the heat causes expansion of the element so that pin 17A moves to latching position as shown in FIG. 7B prior to the temperature in the ovenreaching the selected temperature. This latches the door and prevents access to the oven or other during the heating period.

Flow of electric current is controlled by switch 43 which is closed upon initiation of the cleaning cycle and is turned off after the cycle is completed.

In accordance with the present invention it is recognized that continuous flow of electric current to the memory element for a long period of time may adversely affect the element so means can be provided to control the flow of electricity to the element and examples are shown in FIGS. 8A–8B to 10A–10B.

Figure 8A:
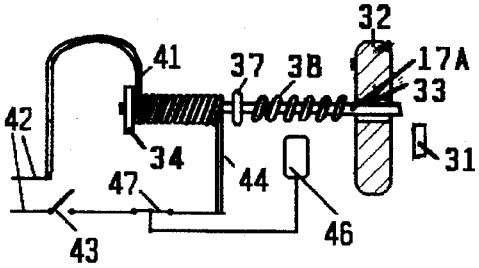
FIGS. 8A and 8B illustrate arrangements within the scope of the present invention where an electrical current is provided in the memory metal and control means are provided to control current flow in the metal.
Figure 8B:
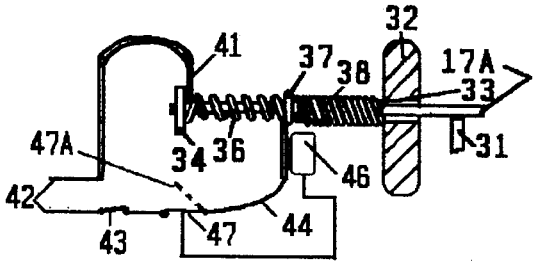

In FIGS. 8A–8B, a proximity detector 46 is provided to detect ferrous material and as element 36 is heated by current flowing through the element and pin 17 moves toward the latched position, detector 46 detects an occurrance such as movement of stop 37 moving into range and operates a normally closed switch 47 in series in the power supply line to the open position as shown in FIG. 8B.

Thus current flow to element 36 is terminated. If the temperature in the oven or other area does not reach the selected temperature before element 36 cools below the temperature then switch 47 closes and reheats element 36.

Figure 9A:
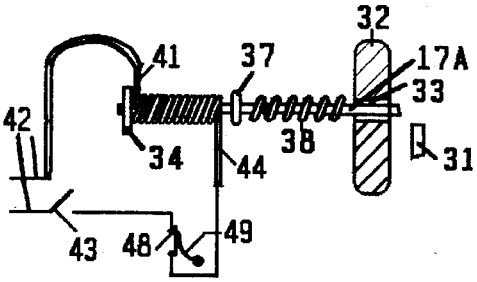
FIGS. 9A and 9B illustrate yet another arrangement within the scope of the present invention where an electrical current is provided in the memory metal and control means are provided to control current flow in the metal.
Figure 9B:
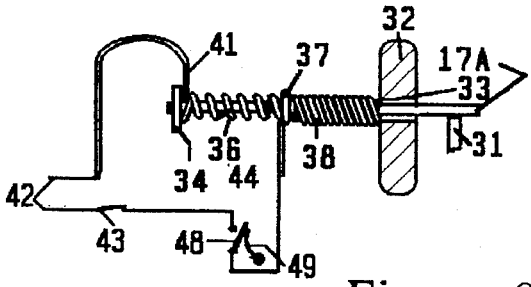

FIGS. 9A and 9B illustrate a similar arrangement where a bimetal strip 49 actuates a switch 48 located in the oven or other area to be heated.

Figure 10A:
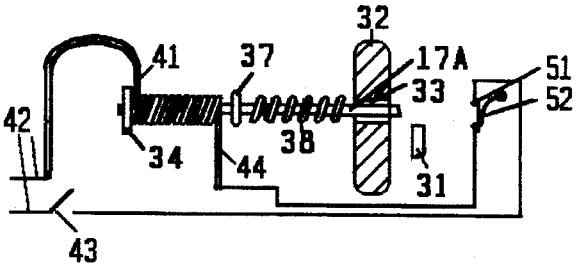
FIGS. 10A and 10B illustrates even other arrangements within the scope of the present invention where an electrical current is provided in the memory metal and control means are provided to control current flow in the metal.
Figure 10B:
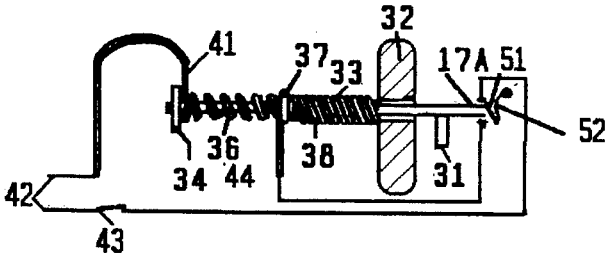

Likewise, FIGS. 10A–10B illustrate an arrangement where pin 17A opens a switch 51 when the element is extended.

Figure 11A:
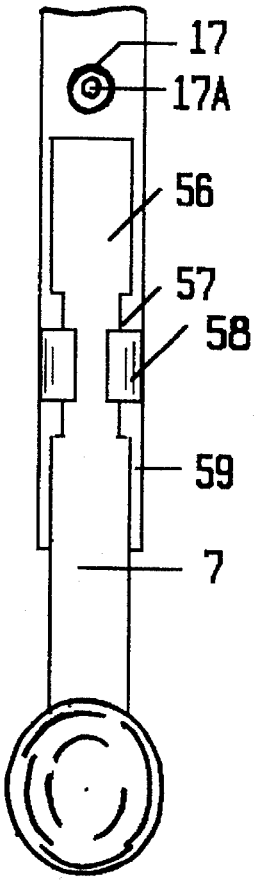
FIGS. 11A and 11B illustrate an arrangement within the scope of the present invention where an appliance door can be closed and the associated oven operated at elevated temperature with the door in the unlatched position.
Figure 11B:
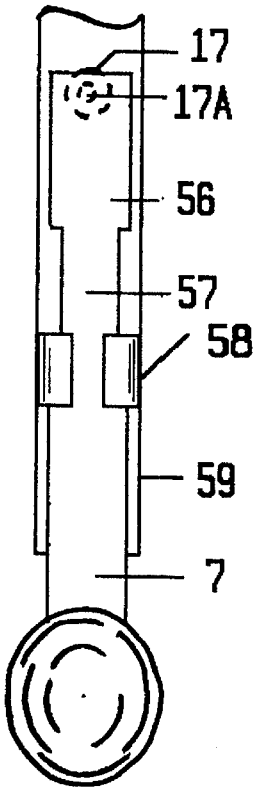

FIGS. 11A and 11B illustrate another feature within the scope of the present invention for use where it is desired to operate the oven at an elevated temperature with the door fully latched in the position normally used for high temperature cleaning with to prevent escape of gasses from the oven.

In FIG. 11A the handle 7 shown in FIG. 1 is shown to include a reduced section 57 received in a guide 58 on an arm 59 which moves with arm 7. The arm 59 allows the handle to be advanced as shown in FIG. 10B to close off opening 17 to prevent pin 17A from latching the door if desired.

It will be understood that the foregoing are but examples of arrangements within the scope of the present invention and that other arrangements also within the scope of the present invention will occur to those skilled in the art upon reading the disclosure set forth hereinbefore.

The invention claimed is:

1. A lock for an oven door including latch means having alignment holes means and the latch means is movable between latched position to engage the oven door and hold the oven door closed and an unlatched position where the oven door is released where the lock locks the latch means in the latched position when the temperature of the lock exceeds a preselected elevated temperature where said lock includes: locking pin means to selectively engage the alignment hole means to hold the latch means in latched position at temperature above the elevated temperature so the latch means cannot be released to allow the oven door to be opened; frame means to hold said locking pin means in position to engage said alignment hole means; first spring means carried by said frame means and disposed to urge said locking pin means away from said alignment hole means and second spring means carried by the frame means and positioned to oppose a force exerted by said first spring means where a force exerted by the second spring means is a function of the temperature of the second spring means so that at the selected elevated temperature the force exerted by the second spring means exceeds the force exerted by the first spring means and the locking pin means is moved into said alignment hole means to prevent release of the oven door so long as the temperature of said second spring means exceeds the selected elevated temperature.

2. The invention of claim 1 wherein said first spring means force is provided by a weight of said locking pin.

3. The invention of claim 1 including heat means to selectively heat said second spring means to said selected temperature.

4. The invention of claim 3 wherein said heat means includes electrical current passed through said second spring means.

5. The invention of claim 3 including detector means to detect when said locking pin means is in said alignment hole means in said latch and switch means operated by said detector means to terminate operation of said heat means when said locking pin means is in said alignment hole means.

6. The invention of claim 1 including block means carried by said frame means to selectively prevent said locking pin means from entering said alignment hole means in said latch means at said elevated temperature.

* * * * *